US006702625B2

(12) United States Patent
Endo

(10) Patent No.: US 6,702,625 B2
(45) Date of Patent: Mar. 9, 2004

(54) SIDE SPACER STRUCTURE IN CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/265,140

(22) Filed: Oct. 7, 2002

(65) Prior Publication Data

US 2003/0087563 A1 May 8, 2003

(30) Foreign Application Priority Data

Oct. 5, 2001 (JP) ..... P2001-309934

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,830,013 A * 11/1998 Saito et al. ..... 439/752
5,931,707 A * 8/1999 Ito ..... 439/752
6,066,008 A * 5/2000 Brantingham et al. ..... 439/752

FOREIGN PATENT DOCUMENTS

JP 6-215821 8/1994
JP 10-289746 10/1998

* cited by examiner

*Primary Examiner*—Gary Paumen
(74) *Attorney, Agent, or Firm*—Sughrue Mion, PLLC

(57) ABSTRACT

A side spacer in a connector is attached by insertion to a housing body from a side thereof and a terminal abutting portion having an inclination angle β is formed in at least one side edge of a lance for temporarily retaining a terminal. The inclination angle β is set greater than an angle α formed between an imaginary line connecting the corner portion of the upper surface at the tip end of a female terminal and the corner portion of the upper surface of a tentative retaining projection and the inserting direction of said terminal into the connector housing.

2 Claims, 5 Drawing Sheets

SIDE SPACER STRUCTURE IN CONNECTOR

The present invention is based on Japanese Patent Application No. 2001-309934, which is incorporated herein by reference.

BACKGROUND OF THE INVENTION

1. Field of the Invention

The present invention relates to a side spacer in a connector and more particularly to a side spacer structure in a connector, which structure is designed so that a connecting terminal can easily be fitted into a terminal receiving chamber when the connecting terminal is fitted into the chamber.

2. Description of the Related Art

As shown in FIG. 6, a conventional female connecting terminal 1 has a contact portion 1*a,* which is the one molded into the form of a case by bending a copper alloy sheet. As shown in FIG. 7, further, convex portions 1*b* formed by bending the respective end portions of the sheet are formed on the upper surface of the contact portion 1*a*.

The female connecting terminal 1 is fitted into a terminal receiving chamber 2*a* formed in a housing body 2. Then the front end projection 2*c* of a lance 2*b* formed in the terminal receiving chamber 2*a* is joined to the convex portions 1*b* whereby to hold the female connecting terminal 1 in the housing body 2 with the connecting terminal 1 prevented from slipping off.

However, with progress in reducing the size of equipment, there has developed a demand for reduction in the size of connectors themselves. In the case of the conventional connector as described above, it is hardly easy to manufacture such a housing body 2 and a female connecting terminal 1 that are smaller in size. Particularly as the lance 2*b* and the convex portions 1*b* are being rendered extremely small in size, a problem resulting from this arrangement is that molding the lance 2*b* as well as forming the convex portions 1*b* through bending work is difficult.

Further, as an area where the lance 2*b* and the convex portions 1*b* are joined together is on the decrease with a reduction in their size, the joining force tends to become deficient. In case where pulling-out force acts on the female connecting terminal 1, the lance 2*b* made of synthetic resin having a small retaining margin is scraped with the convex portions 1*b*. Another problem resulting from the arrangement above is that the female connecting terminal 1 may incompletely be retained in the housing body 2.

Still another problem resulting from the arrangement above is that it is difficult to ensure that a male connecting terminal is connected to the female connecting terminal 1.

In order to provide sufficient joining force, moreover, though a proposal has been made to increase an area where the female connecting terminal 1 is joined to the lance 2*b* by forming a large projection on the female connecting terminal 1, fitting the female connecting terminal 1 into the housing body 2 tends to become difficult because the projection constitutes an obstacle to the fitting operation, whereby it is hardly easy to form a sufficiently large projection on a small female connecting terminal 1.

SUMMARY OF THE INVENTION

An object of the invention is to provide a side spacer structure in a connector so that a connecting terminal can easily be fitted into a housing body and that by securely retaining the connecting terminal inside, the connector is prevented from being fitted in halfway.

(1) A side spacer structure in a connector according to the invention, comprises a connector housing having at least one of terminal receiving chambers in each of which a terminal is accommodated;

the terminal including a first corner portion which is located at a tip end on an upper surface of the terminal in an inserting direction thereof into the connector housing and a second corner portion which is located on an upper surface of a tentative retaining projection projecting from the upper surface of the terminal; and a side spacer mounted in the connector housing from a side thereof;

the side spacer including an outer member having a U-shape, a branch plate projecting from the outer member in a direction in which the side spacer is inserted to the connector housing, the branch plate provided with a tentative retention lance for temporarily retaining the terminal inserted into the terminal receiving chambers from a fitting side of the connector housing, and a securing portion for securing the terminal in a state for operation;

wherein an inclination angle of a side edge of the tentative retention lance is greater than an angle of formed between an imaginary line connecting the first corner portion and the second corner portion and the inserting direction of the terminal into the connector housing.

With the above arrangement of the side spacer structure in the connector, the first corner portion of the upper surface at the tip end of the connecting terminal invariably abuts the underside of the tentative retaining lance, which causes the tentative retention lance to be bent upward and fitted in against the generated resilient force when the connecting terminal is inserted into the housing body. The connecting terminal is fitted in while making the tentative retention lance slide on the flat upper surface of the connecting terminal.

Therefore, the insertion resistance of the connecting terminal is set such that the connecting terminal can easily be fitted in with a constant sliding resistance until the tip end of the connecting terminal comes to contact the mating wall of the housing body upon completion of the insertion of the connecting terminal. The completion of the insertion can surely be decided by a sharp increase in the insertion resistance derived from the contact of the connecting terminal with the mating wall of the housing body, whereby the connecting terminal is prevented from being fitted in halfway.

(2) A side spacer structure in a connector according to the invention, the tentative lance may include a terminal abutting portion provided on the side edge thereof, wherein the tip end of the connecting terminal comes to contact the terminal abutting portion when the connecting terminal is inserted.

With the above arrangement of the side spacer structure, the terminal abutting portion is provided in at least one side edge of the tentative retention lance. As the tip end of the connecting terminal invariably contacts the terminal abutting portion and makes the tentative retention lance bend upward when the connecting terminal is inserted, the tentative retaining projection formed on the upper surface of the connecting terminal can be inserted without contacting the tentative retention lance. Thus, the connecting terminal can easily be fitted in since the insertion resistance remains unchanged, so that terminal insertability is greatly improved.

DETAILED DESCRIPTION OF THE PREFERRED EMBODIMENT

Figure 1:
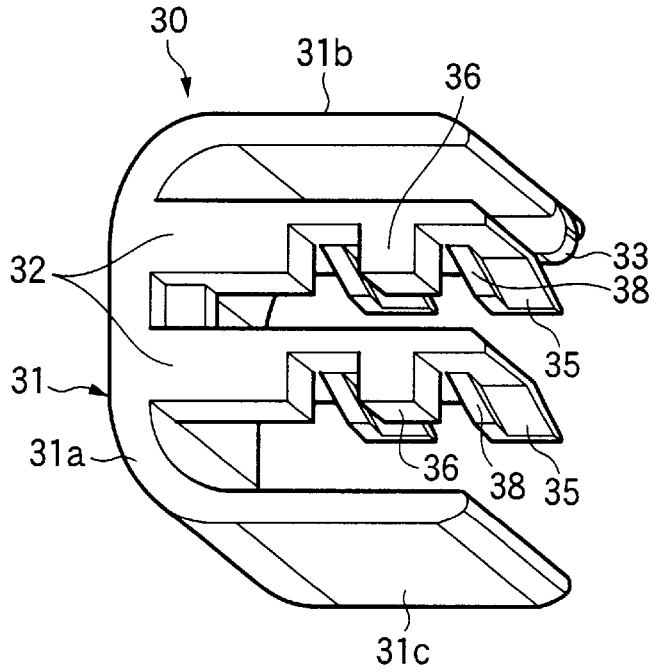
FIG. 1 is a perspective view of a side spacer structure in a connector embodying the invention.
Figure 2:
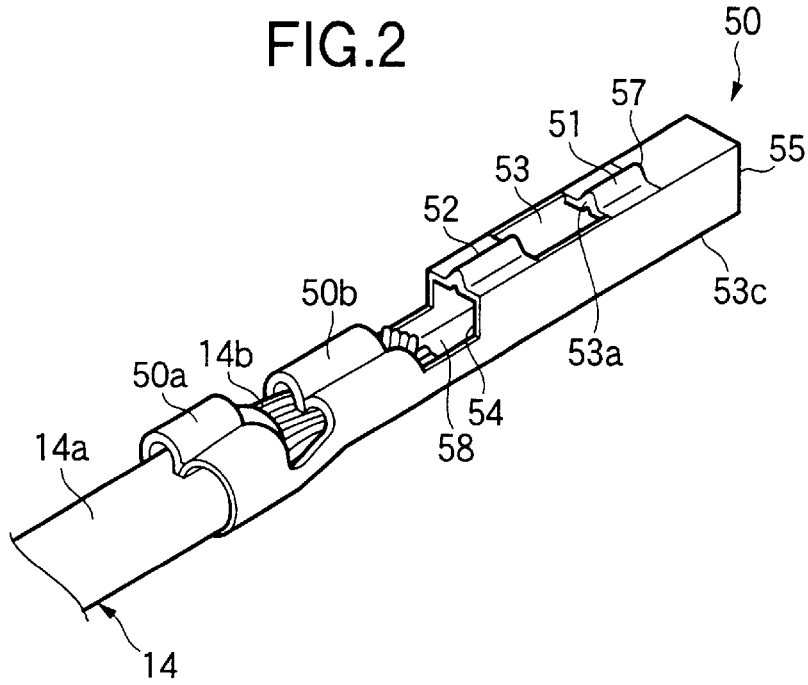
FIG. 2 is a perspective view of a connecting terminal retained securely with a side spacer of FIG. 1.
Figure 3:
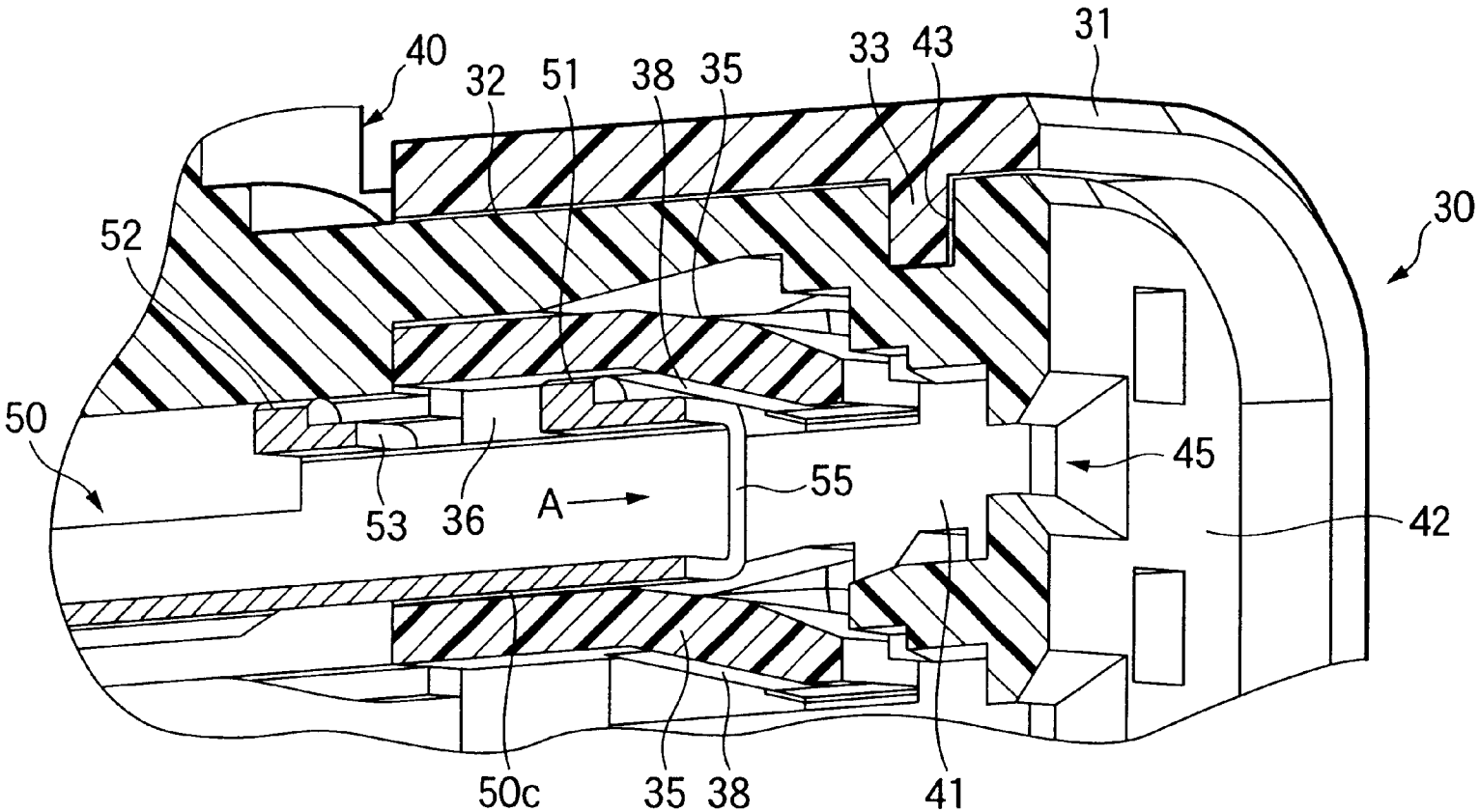
FIG. 3 is a partially exploded vertical sectional view of the side spacer of FIG. 1 in a temporarily retained condition.
Figure 4:
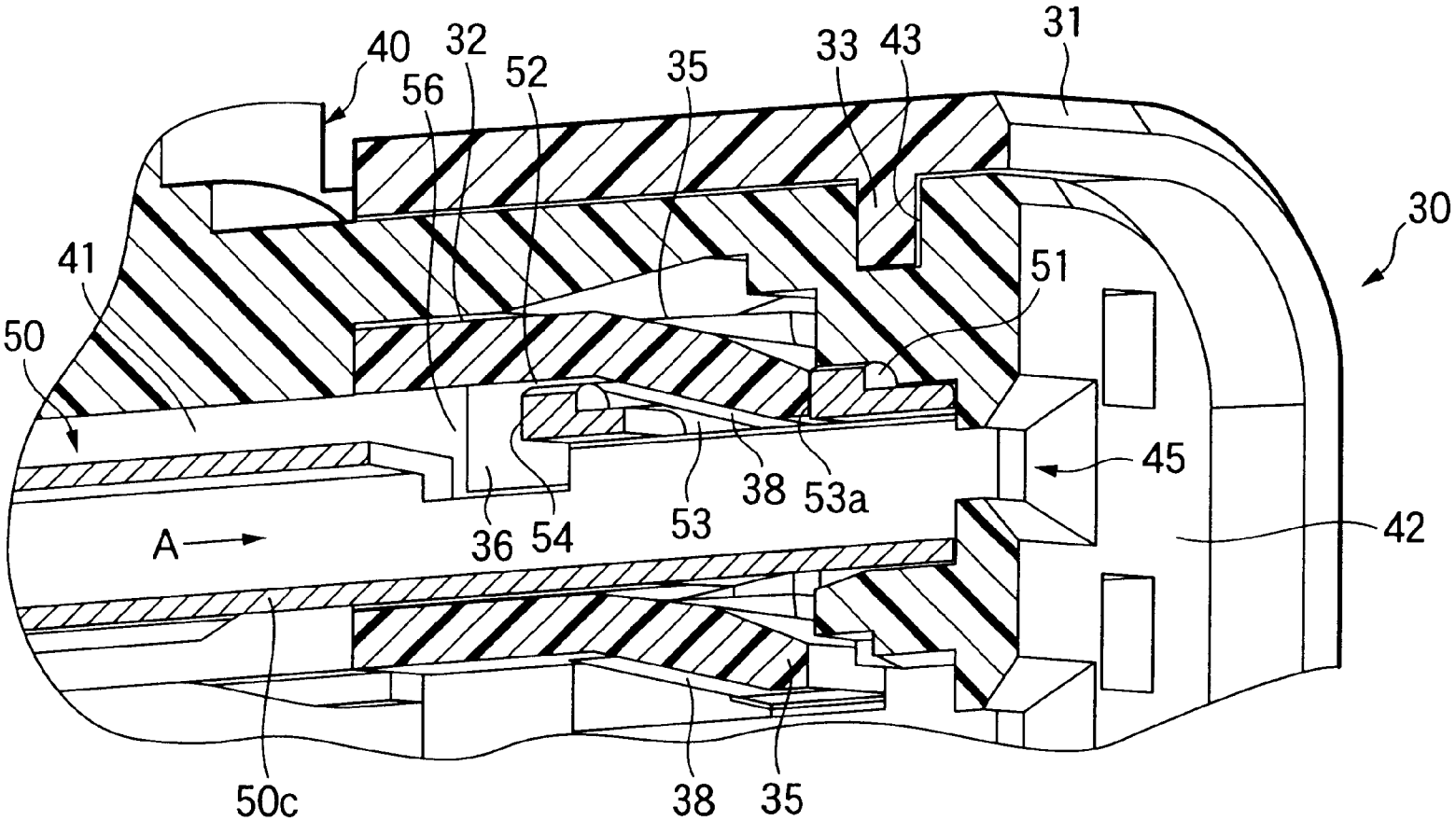
FIG. 4 is a partially exploded vertical sectional view of the side spacer of FIG. 1 in a finally secured condition.

A description will now be given of a side spacer structure in a connector embodying the invention with reference to FIGS. 1 to 5. FIG. 1 is a perspective view of a side spacer structure in a connector embodying the invention; FIG. 2, a perspective view of a connecting terminal retained securely with a side spacer of FIG. 1; FIG. 3, a partially exploded vertical sectional view of the side spacer of FIG. 1 in a temporarily retained condition; FIG. 4, a partially exploded vertical sectional view of the side spacer of FIG. 1 in a finally secured condition; and FIG. 5, a diagram explanatory of a condition in which the side spacer and the connecting terminal are in contact with each other.

The connector applied according to this embodiment of the invention has a side spacer 30, a housing body 40 and a female terminal 50, the side spacer 30 being fitted into the housing body 40 from its side portion. More specifically, the side spacer 30 is attached by insertion to the temporary retaining position of the housing body 40 beforehand and the female terminal 50 is fitted into a terminal receiving chamber 41 and then the side spacer 30 is forced into the final retaining position. Thus, the female terminal 50 fitted into the terminal receiving chamber 41 is finally secured inside and prevented from slipping off the housing body 40.

As shown in FIG. 1, the side spacer 30 is formed by injection-molding synthetic resin and two branch plates 32 are projected in parallel from the U-shaped base portion of an outer member 31 that is U-shaped in cross section toward the open end of the side spacer 30. When the side spacer 30 is fitted into the housing body 40, plate-like lances 35 for temporarily retaining terminals and block-like securing portions 36 for securing the terminals are alternately formed and projected from the respective branch plates 32, the lances 35 being formed so as to gradually tilt downward toward the front end 42 of the housing body 40.

When the lance 35 for temporarily retaining the terminal is fitted into the housing body 40, the lance 35 is provided such that it is projected from the branch plate 32 on a side close to the front end 42 of the housing body 40. The securing portion 36 for securing the terminal is formed on the rear end side of the housing body 40, so that the lance 35 for temporarily retaining the terminal and the securing portion 36 for securing the terminal are disposed in a staggered manner.

On the underside of the lance 35 for temporarily retaining the terminal, a rib-shaped terminal abutting portion 38, having a forward inclination angle β (see FIG. 5) is formed in one side edge. A guide rib 33 directed inward is formed at both open ends, which guide rib 33 and the mating groove 43 of the housing body 40 are retained together as will be described later, and incorporated into the housing body 40.

As shown in FIG. 3, the housing body 40 is formed by injection-molding synthetic resin and provided with a plurality of terminal receiving chambers 41 (four of them as shown in FIG. 3 according to this embodiment of the invention), so that the female terminal 50 can be fitted in the direction of an arrow A from the rear end side of each terminal receiving chamber 41. Further, a through hole 45 for receiving a male terminal (not shown) therethrough is formed in a wall provided in the front end 42 of the terminal receiving chamber 41.

The mating groove 43 is formed on the front end side of the vertical face of the housing body 40 and a hole (not shown) for receiving the branch plate 32 of the side spacer 30 is formed on the side thereof. Moreover, an arrangement is made to incorporate the side spacer 30 into the housing body 40 by holding down the side spacer 30 with the guide rib 33 of the side spacer 30 being fitted into the mating groove 43.

As shown in FIG. 2, the female terminal 50 is formed by bending a copper alloy sheet and core wires **14*b* with removal of an insulating covering 14*a* in the front end portion are clamped by a core-wire clamping portion 50*b* and the insulating covering 14*a* is contact-bonded by a covering clamping portion 50*a* whereby to connect the core wires 14*b* to an electric wire 14. A columnar joint 50*c* is provided ahead of the core-wire clamping portion 50*b* and moreover a tentative retaining projection 51 for preventing the female terminal 50 from being fitted into the housing body 40 in error is axially formed in the center of the rear end side on the upper surface of the joint 50*c***.

A temporary retaining groove 53 is formed at the rear end of the tentative retaining projection 51 on the upper surface of the joint **50*c* and a final retaining projection 52 is formed at the rear end of the temporary retaining groove 53. Moreover, a final securing groove 58 is formed at the rear end of the final retaining projection 52. The front end 53*a* of the temporary retaining groove 53 is mated with the lance 35 for temporarily retaining the terminal, whereas the front end 54 of the final securing groove 58 is mated with the securing portion 36** for securing the terminal.

The operation of the side spacer according to this embodiment of the invention will be described next.

As shown in FIG. 3, the branch plate 32 of the side spacer 30 is fitted into the hole formed in the side portion of the housing body 40 with the guide rib 33 of the side spacer 30 being fitted into the mating groove 43 of the housing body 40. In other words, the lance 35 for temporarily retaining the terminal is caused by holding down the side spacer 30 to proceed up to a temporary retaining position wherein the lance 35 for temporarily retaining the terminal is positioned in the terminal receiving chamber 41.

When the female terminal 50 is fitted into the terminal receiving chamber 41 in the direction of the arrow A (in the leftwise direction in FIG. 3) from the rear end of the housing body 40, the tip end 55 of the female terminal 50 comes to contact the terminal abutting portion 38 of the lance 35 for temporarily retaining the terminal.

Figure 5:
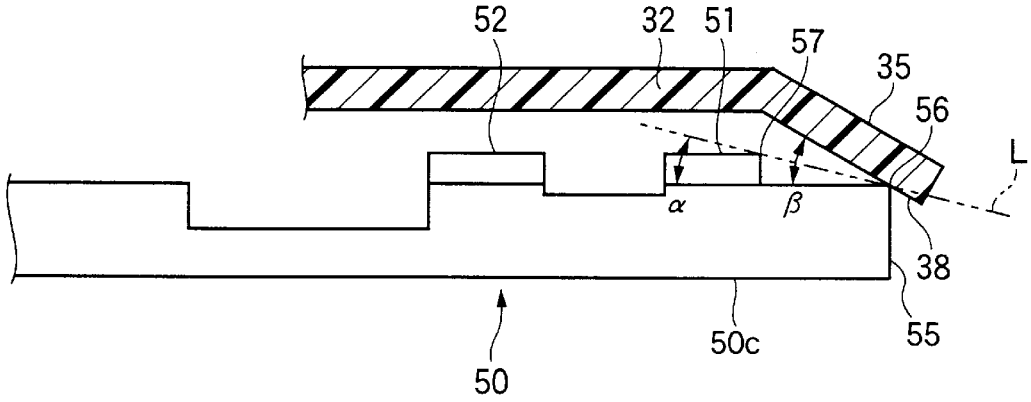
FIG. 5 is a diagram explanatory of a condition in which the side spacer and the connecting terminal are in contact with each other.
Figure 6:
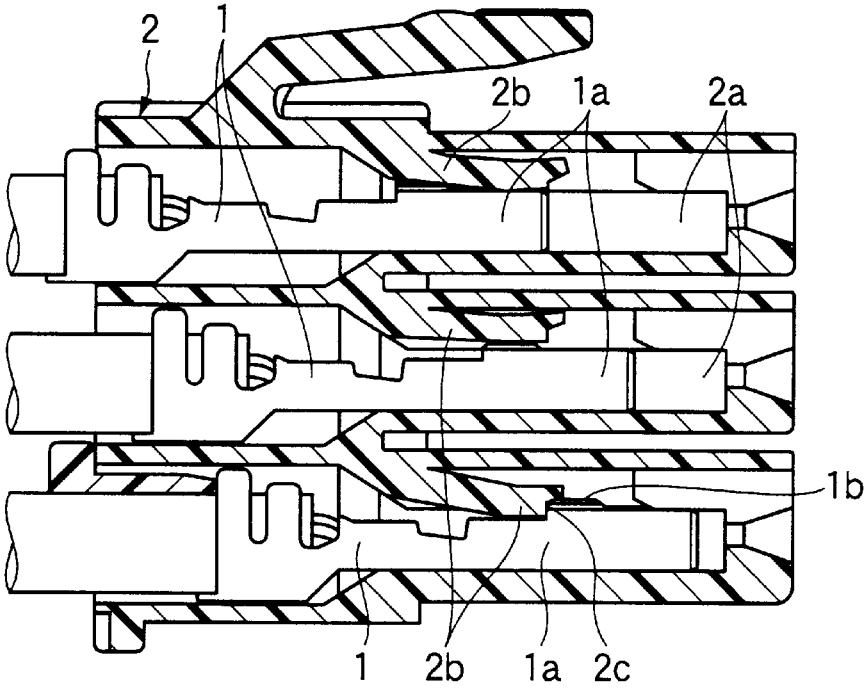
FIG. 6 is a vertical sectional view showing a conventional connector structure.
Figure 7:
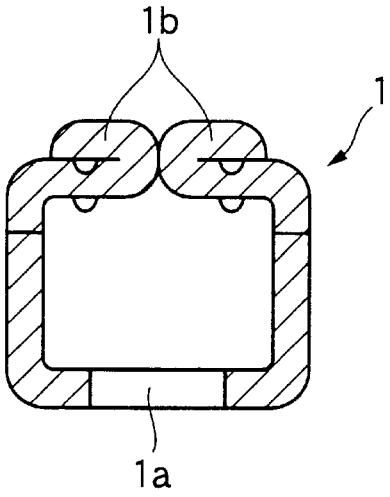
FIG. 7 is a vertical sectional view of a connecting terminal in FIG. 6.

As shown in FIG. 5, the inclination angle β of the terminal abutting portion 38 of the side spacer 30 according to this embodiment of the invention is set greater than an angle α formed between an imaginary line L which connects the corner portion 56 of the upper surface at the tip end of the female terminal 50 and the corner portion 57 of the upper surface of the tentative retaining projection 51 and the insertion direction of the female terminal 50 into the terminal receiving chamber 41. Therefore, the tentative retaining projection 51 never comes to contact the terminal abutting portion 38 but invariably contacts the terminal abutting portion 38.

When the female terminal 50 is held down in the direction of the arrow A as shown in FIG. 4, the lance 35 for temporarily retaining the terminal bends and escapes upward against the resilient force and the terminal abutting portion 38 slides on the upper surface of the joint 50*c* and the side portion of the tentative retaining projection 51. When the female terminal 50 is fitted in the direction of the arrow A, further, the tip end 55 of the female terminal 50 contacts the wall of the front end 42 of the housing body 40.

In this case, the lance 35 for temporarily retaining the terminal returns from the bent condition to the original one and steps into the temporary retaining groove 53 and the female terminal 50 is temporarily retained as the front end 53*a* of the temporary retaining groove 53 joins the lance 35 for temporarily retaining the terminal.

More specifically, the terminal abutting portion 38 never contacts the tentative retaining projection 51 but is fitted in while sliding on the side portion of the tentative retaining projection during the whole process of fitting the female terminal 50 in and as constant resistance force against the insertion acts on the female terminal 50 then, so that the female terminal 50 is readily fitted into the terminal receiving chamber 41.

When the female terminal 50 is fitted in up to the final position, moreover, the tip end 55 of the female terminal 50 comes to contact the wall of the front end 42 of the housing body 40, thus causing resistance against the insertion to increase sharply to ensure that the completion of the fitting work is sensed.

Then the side spacer 30 is held down further to make the securing portion 36 for securing the terminal proceed up to the final retaining position where the securing portion 36 for securing the terminal is fitted into the final securing groove 58. The female terminal 50 can thus be retained finally by joining the securing portion 36 for securing the terminal and the front end 54 of the final securing groove 58.

Unless the female terminal 50 is not fitted in up to the final retaining position, the securing portion 36 for securing the terminal is not allowed to proceed into the final securing groove 58. Consequently, as the side spacer 30 is sticking out of the housing body 40 sideways, it is easily and visually detectable that the female terminal 50 is fitted in incompletely, whereby the female terminal 50 is prevented from being fitted in halfway.

Moreover, as there is formed a large area where the securing portion 36 for securing the terminal is mated with the final securing groove 58, the female terminal 50 is retained in the housing body 40 for certain even though pull-out force acts on the female terminal 50.

Although a description has been given of the side spacer structure applied to the form of employing four female terminals 50 by way of example according to this embodiment of the invention, the structure may also be applied to a multi-female-terminal 50.

As set forth above, with the side spacer structure in the connector according to the invention, the tip end of the connecting terminal invariably contacts the underside of the tentative retention lance, which causes the tentative retention lance to be bent upward and fitted in against the generated resilient force when the connecting terminal is fitted into the housing body. The connecting terminal is fitted in while making the tentative retention lance slide on the flat upper surface of the connecting terminal.

Therefore, the insertion resistance of the connecting terminal is set such that the connecting terminal can easily be fitted in with constant sliding resistance until the connecting terminal comes to contact the mating wall of the housing body upon completion of the insertion of the connecting terminal. The completion of the insertion can surely be decided by a sharp increase in the insertion resistance derived from the contact of the connecting terminal with the mating wall of the housing body, whereby the connecting terminal is prevented from being fitted in halfway without mistaking an increase in the insertion resistance during the process of fitting the connecting terminal in for the completion of the insertion.

With the side spacer structure in the connector according to the invention, the terminal abutting portion is provided in at least one side edge of the tentative retention lance, and the tip end of the connecting terminal invariably contacts the terminal abutting portion and makes the tentative retention lance bend upward when the connecting terminal is fitted in. Accordingly, as the tentative retaining projection formed on the upper surface of the connecting terminal is fitted in without contacting the tentative retention lance, the connecting terminal can easily be fitted, so that terminal insertability is greatly improved.

What is claimed is:

1. A side spacer structure of a connector comprising:

a connector housing having at least one of terminal receiving chambers in each of which a terminal is accommodated;

said terminal including a first corner portion which is located at a tip end on an upper surface of the terminal in an inserting direction thereof into the connector housing and a second corner portion which is located on an upper surface of a tentative retaining projection projecting from the upper surface of the terminal; and a side spacer mounted in said connector housing from a side thereof;

said side spacer including an outer member having substantially a U-shape, and a branch plate projecting from said outer member in a direction in which said side spacer is inserted to said connector housing, said branch plate provided with a tentative retention lance for temporarily retaining the terminal inserted into said terminal receiving chambers from a fitting side of the connector housing, and a securing portion for securing the terminal in a state for operation;

wherein an inclination angle of a side edge of the tentative retention lance is greater than an angle formed between an imaginary line connecting the first corner portion and the second corner portion and the inserting direction of the terminal into the connector housing.

2. A side spacer structure according to claim 1, the tentative lance including a terminal abutting portion provided on a side edge of the tentative retention lance, wherein the inclination angle of said terminal abutting portion is greater than an inclination angle of the other portion of said tentative retention lance, and the tip end of the connecting terminal comes to contact the terminal abutting portion when the connecting terminal is inserted.

* * * * *